United States Patent [19]

Zelenko et al.

[11] Patent Number: 4,703,943

[45] Date of Patent: Nov. 3, 1987

[54] SAMPLE BOOK CONSTRUCTION

[76] Inventors: Harry Zelenko; Marion Zelenko, both of 240 E. 61st St., New York, N.Y. 10021

[21] Appl. No.: 478,358

[22] Filed: Mar. 24, 1983

[51] Int. Cl.[4] ..... B42D 1/00; B41L 1/20; B65D 5/52

[52] U.S. Cl. ..... 281/21 R; 282/8 R; 206/44 R

[58] Field of Search ..... 206/44 R; 281/21, 21 R; 282/8 R; 434/75, 81, 98, 99, 365, 367

[56] References Cited

U.S. PATENT DOCUMENTS

| | | | |
|---|---|---|---|
| 586,925 | 7/1897 | Lozawo | 282/8 R |
| 1,196,449 | 8/1916 | Enholm | 281/21 R |
| 1,385,590 | 7/1921 | Shoemaker | 281/21 R |
| 2,343,119 | 2/1944 | Zaslawsky | 281/21 R |
| 2,625,261 | 1/1953 | Swift | 206/44 R |
| 2,707,839 | 5/1955 | Green, Jr. | 206/44 |
| 2,783,880 | 3/1957 | Kayton et al. | 206/44 R |
| 3,279,472 | 10/1966 | Toman | 281/21 R |
| 3,430,364 | 3/1969 | Kirschbaum et al. | 434/75 |
| 3,530,984 | 9/1970 | Howard | 434/75 |
| 3,570,071 | 3/1971 | Wardell . | |
| 3,762,985 | 10/1973 | Chaitman | 434/75 |
| 3,811,998 | 5/1974 | James . | |
| 3,965,583 | 6/1976 | Price | 434/75 |
| 4,138,143 | 2/1979 | Lawes . | |

FOREIGN PATENT DOCUMENTS

| | | | |
|---|---|---|---|
| 427744 | 4/1955 | United Kingdom | 281/21 |

OTHER PUBLICATIONS

Plastic Process Company, 7/1953, p. 35.
Anchor Plastics, 1960, p. 6.

*Primary Examiner*—Paul A. Bell
*Assistant Examiner*—Paul M. Heyrana, Sr.
*Attorney, Agent, or Firm*—Richard S. Roberts

[57] ABSTRACT

The invention provides an improved sample card and sample book arrangement having several permanently mounted specimens of fabrics attached to said book. Also attached to said sample book are a plurality of sample swatches of said fabric specimens which are quickly removable via a perforated edge mounting.

10 Claims, 6 Drawing Figures

SAMPLE BOOK CONSTRUCTION

BACKGROUND OF THE INVENTION

The present invention relates to sample books, especially books intended for the display of film, fabric, cloth, carpet, papers, wallpapers, and other similar articles.

It has been well known in the art to produce books of sample fabrics, or the like, which a vendor typically would use to display exemplary specimens of his goods. Such goods are usually relatively flat, flexible articles which are bound together at their top or side edge to form a portfolio-like compilation. A potential vendee would then be able to peruse through the samples by simply paging through each leaf of the book. By briefly bending one or more of the samples, the vendee can thereby compare a plurality of such samples as required for his specific needs.

There has, however, been a problem with such a procedure. Frequently the vendee has a need for a swatch of the sample for color matching, fabric comparisons, identification, or to contrast the particular sample with those of other vendors. Most solutions to this problem have been unsatisfactory. Either the vendor must leave the entire sample book with the vendee for an indefinite period of time, or a piece of the original sample is physically cut from the sample page, or a sample must be ordered from the fabric manufacturer for subsequent transmission to the vendee. These solutions have been costly, unnecessarily destructive or actually cause lost sales.

The present invention solves this problem by providing a sample book having both full size samples plus a plurality of miniature swatches which are easily removable by several vendees for their commercial needs. Such swatches preferably are either themselves perforated along at least one edge or are disposed on cards which are perforated for easy tearing out of sample books. Preferably such swatches bear some identifying indicia, for example, vendor or manufacturer name, style number, etc.

SUMMARY OF THE INVENTION

The invention provides an improved sample card which comprises a plurality of substantially planar swatches of specimens which are relatively quickly removably attached to a support by means of a series of perforated connections along at least one side of said swatch also. A swatch can be considered a piece of a specimen which is attached to a paper or cardboard substrate in which case the paper or cardboard is perforated for removal. Such a swatch is preferably attached to the sample card by a glue-line such that removed swatches may be replaced.

The invention also provides an improved sample book which comprises a plurality of specimens which are relatively permanently mounted on said book, and a plurality of swatches of said specimens which are quickly removably attached to said book. Preferably the swatches are attached by a perforated edge mounting for easy removal.

DETAILED DESCRIPTION OF THE PREFERRED EMBODIMENT

In the preferred embodiment the present invention provides an improved sample book construction which contains both relatively permanently mounted specimens of a sample as well as quickly removable swatches of each of said specimens for use, for example, by customers, color matchers, etc.

Figure 1:
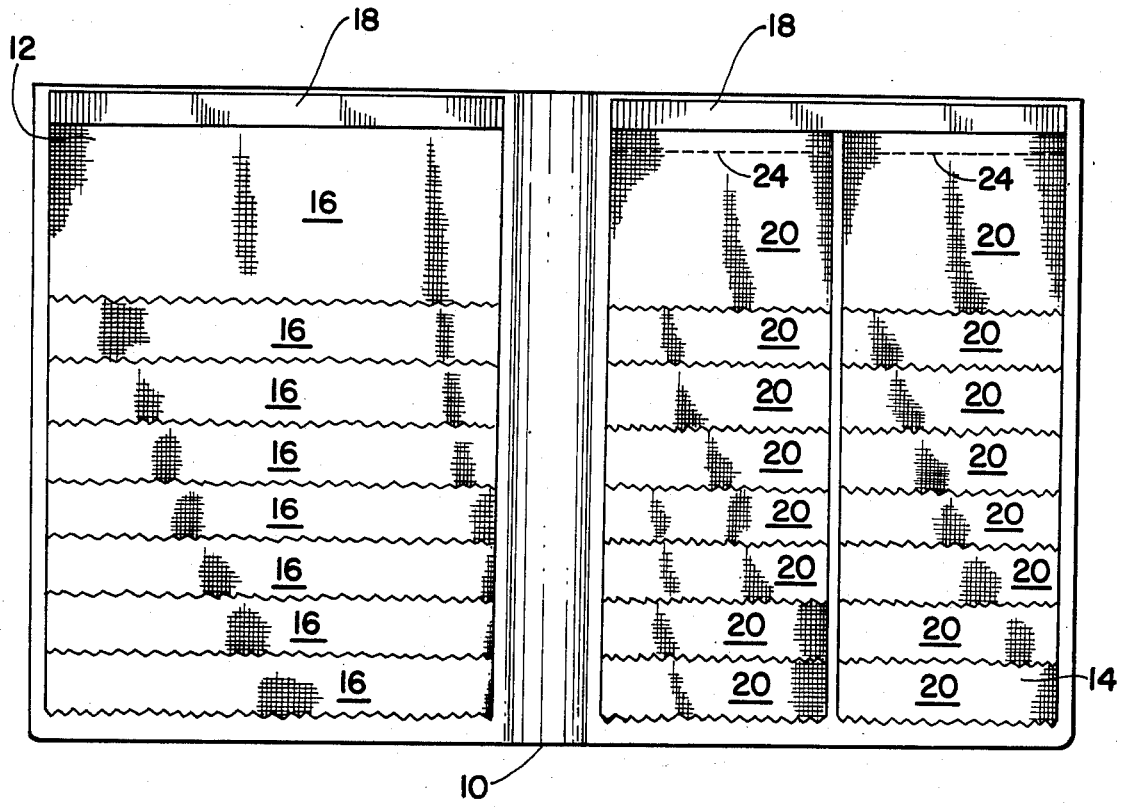
FIG. 1 is a front perspective view of a sample book construction according to the present invention.
Figure 2:
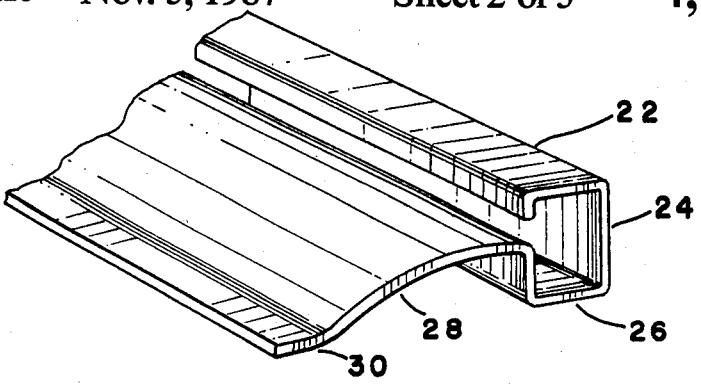
FIG. 2 is a perspective view of the swatch leveling apparatus of the present invention.
Figure 3:
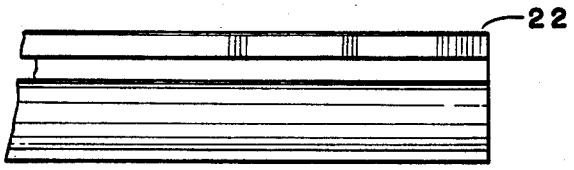
FIG. 3 is a front view of the swatch leveling apparatus of the present invention.
Figure 4:
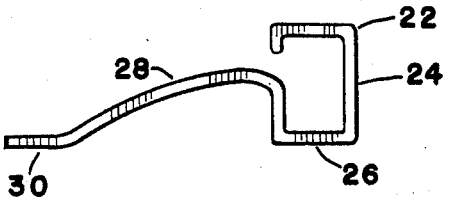
FIG. 4 is a side elevational view of the swatch leveling apparatus of the present invention.
Figure 5:
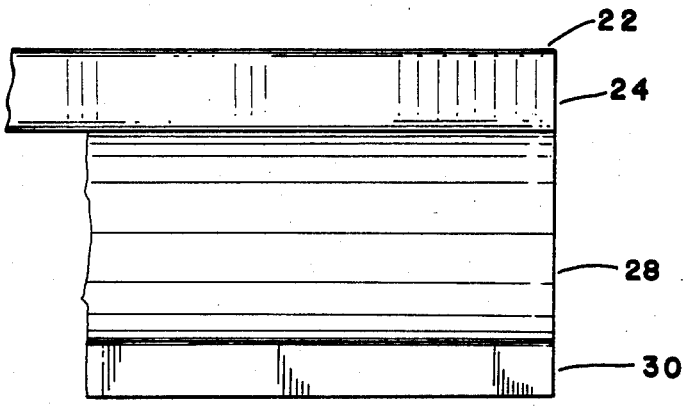
FIG. 5 is a top view of the swatch leveling apparatus of the present invention.

FIG. 1 presents one embodiment of the invention which shows a sample book 10 having two sample cards 12 and 14. Sample card 12 is shown to comprise a plurality of sample specimens 16 which are relatively permanently mounted on a sample card support. Said support may be bound to the sample book by suitable means 18. Attached to sample card 14 are a plurality of quickly removable swatches 20 which can be torn from their sample card for use by customers. In the preferred embodiment such swatches are removably mounted on the sample card via a perforated connection shown at 24 for the upper level swatches.

In use, the customer pages through the collection of full specimens 16. When he has tentatively decided to select one or more of such specimens, he merely finds the corresponding easily removable swatch 20 of the same material. He may then remove one of these swatches for future use. In various other embodiments, the swatches may be directly connected to the sample card, or in the alternative, the swatch may be attached to the sample card by connection through the main specimen. Also, a series of swatches may be removably connected to one another to provide samples to many customers. In still another preferred embodiment, the swatches may be mounted in such a manner that they may be replaced when their supply is exhausted. In yet another embodiment, permanent and removable samples may be attached to the same sample card. A series of permanent and removable samples may, for example, alternately overlay on one another on a single card. In one most preferred embodiment a swatch comprises a piece of a specimen which is attached to a substrate, such as paper or cardboard which itself is perforated for tear out removal. Such a swatch as shown in FIG. 6 is attached to the sample card 25 by a glue-line 27, of for example a pressure sensitive adhesive, to allow replacement of removed swatches.

Figure 6:
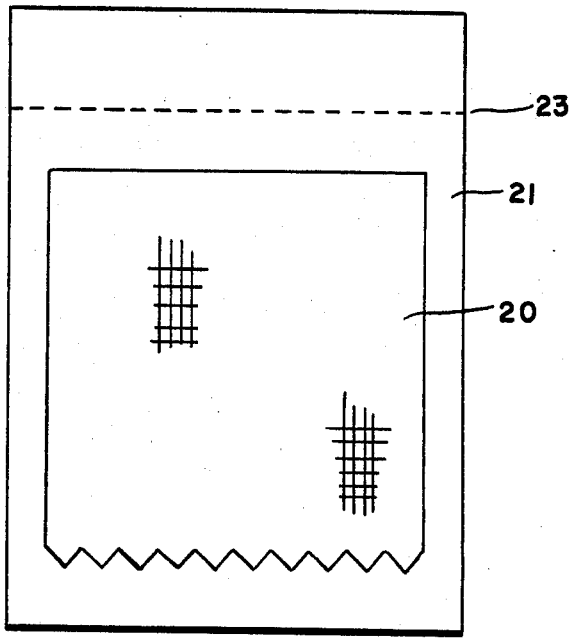
FIG. 6 is a perspective view of a fabric swatch attached to a substrate, which substrate has a perforation line for detachment.

FIG. 6 shows a form of the invention wherein swatch 20 is attached to substrate 21. Substrate 21 has a perforation line 23 which one tears along in order to remove swatch 20.

It is obvious that the presently described system is most effective when the samples to be demonstrated are generally planar and flexible so that they may lie upon each other, however the invention is not limited for use by only such specimens. However, in the more preferred embodiments, the invention is most particularly adapted for such specimens as cloths, fabrics, carpets, papers, wallpaper, decorative coverings, films and the like. The individual sample cards can be bound into sample books by any known mechanism. Such may include stapling, sewing, gluing, ring-type binding and especially by a novel swatch levelling binder apparatus described in U.S. patent application Ser. No. 478,359, filed on even date herewith. Such is an apparatus for leveling sample swatches on a sample card in order to alleviate the detrimental cumulative cascading lift effect of overlapping planar samples. It is an apparatus for binding and/or raising the level of at least a portion of one or more swatches of planar samples on a sample card. In another preferred embodiment each of the specimens and swatches bear identifying indicia, for example on their reverse side which may indicate such information as supplier name, style number, color tone, price, composition and ordering terms. In one embodiment of the invention, the sample card is positioned in the sample book by a swatch leveling apparatus substantially as shown and described in drawing FIGS. 2 through 5 herein. The swatch leveling apparatus 22 comprises a generally C-shaped tubular member 24 having a relatively flattened surface 26 at its lowermost portion which provides a gluing surface. It further has a generally downwardly curving slide member 28 positioned at the lowermost lip of said C-shaped tubular member and extends along the length of the tubular member 24. The width of the slide member extends downward for a distance until it is about co-planar the said flattened surface 26 at about point 30. When this swatch leveling apparatus is used, it alleviates the cascading lift effect of overlapping swatch. As is well known, when swatches are staggered along a display, the thickness of the bundle of lower lying swatches is greater than the thickness of the bundle at the upper portion simply because there are more fabrics at the bottom. The uppermost fabric has no underlying swatches and therefore lies closer to the back of the sample book—further away from the eye of the observer. This gives the bundle an unequal height since portions are built-up and portions are not. The aforementioned device raises the height of the uppermost part of the bundle and gives the entire bundle an optically flat appearance. Also, when the swatch leveling apparatus is used in a sample book configuration, it keeps the spine of the book at right angles to the front and back covers when the book is folded.

It is of course to be understood that the foregoing description of the preferred embodiment is intended to illustrate the invention and that numerous changes and modifications thereof can be made without departing from the spirit and scope of the invention as defined in the claims appended hereafter.

What is claimed is:

1. An improved sample book which comprises at least one improved sample card bound in a book-like configuration, said sample card comprises a plurality of swatches of specimens which are relatively quickly removably attached to a support by means of a series of perforated connections along at least one side of each of said swatches; and said sample card being positioned in said sample book by a swatch leveling apparatus, which swatch leveling apparatus comprises: a generally C-shaped tubular member having a relatively flattened surface at its lowermost portion, and a generally downwardly curving slide member positioned at the lowermost lip of said C-shaped tubular member and extending along the length thereof, the width of said slide member extending downward for a distance until it is about co-planar with said flattened surface.

2. The improved sample book of claim 1 wherein said swatches specimens are selected from the group consisting of fabrics, papers, films and carpets.

3. The improved sample book of claim 1 wherein said swatches bear identifying indicia thereon.

4. The improved sample book of claim 1 wherein said swatches are replaceably mounted on said support.

5. The improved sample book of claim 1 which comprises a plurality of specimens which are relatively permanently mounted on a support, and a plurality of swatches of said specimens which are relatively quickly removably attached to said support.

6. The improved sample book of claim 1 which comprises a plurality of fabric specimens which are relatively permanently mounted on a support; said swatches being attached to said support at a position spaced from but in the immediate proximity to its corresponding permanently mounted specimen.

7. The improved sample book of claim 6 wherein one or more of said specimens and said swatches bear identifying indicia thereon.

8. The improved sample book of claim 1 wherein at least one of said swatches bears at least one additional quickly removably attached swatch of its specimen.

9. The sample book of claim 1 wherein each of said swatches comprises a piece of a specimen which is attached to a substrate, which substrate is quickly removably attached to said support via a series of perforated connections along at least one side thereof.

10. The sample book of claim 7 wherein said perforated substrate is attached to said support by an adhesive.

* * * * *